US008499952B2

(12) United States Patent
Ritzberger et al.

(10) Patent No.: US 8,499,952 B2
(45) Date of Patent: Aug. 6, 2013

(54) TRANSPORT CONTAINER

(75) Inventors: Axel Ritzberger, Altendorf (CH); Dirk Schoenrock, Wolfsburg (DE); Wolfgang Faust, Scheuttorf (DE); Juergen Schink, Rieseberg (DE); Uwe Wojtkowski, Braunschweig (DE)

(73) Assignee: Georg Utz Holding AG, Bremgarten (CH)

( * ) Notice: Subject to any disclaimer, the term of this patent is extended or adjusted under 35 U.S.C. 154(b) by 0 days.

(21) Appl. No.: 13/389,933

(22) PCT Filed: Aug. 11, 2010

(86) PCT No.: PCT/EP2010/004897

§ 371 (c)(1),
(2), (4) Date: Feb. 10, 2012

(87) PCT Pub. No.: WO2011/018211

PCT Pub. Date: Feb. 17, 2011

(65) Prior Publication Data

US 2012/0292310 A1 Nov. 22, 2012

(30) Foreign Application Priority Data

Aug. 12, 2009 (DE) ..... 10 2009 036 993

(51) Int. Cl.

| | |
|---|---|
| ***B65D 88/00*** | (2006.01) |
| ***B65D 25/04*** | (2006.01) |
| ***B65D 1/22*** | (2006.01) |
| ***B65D 85/00*** | (2006.01) |

(52) U.S. Cl.

USPC ..... 220/1.5; 220/520; 220/531; 220/529; 220/533; 220/552; 206/747; 206/723

(58) Field of Classification Search

USPC ..... 220/1.5, 520, 531, 529, 559, 532, 220/533, 552; 206/747, 723, 6, 188, 193, 206/257, 256, 561–564; 229/120.02, 120.22, 229/120.34, 120.08, 120.31, 120.36, 120.38, 229/120.18

See application file for complete search history.

(56) References Cited

U.S. PATENT DOCUMENTS

| | | | | |
|---|---|---|---|---|
| 2,078,430 | A * | 4/1937 | Walsh | 206/521.8 |
| 2,203,240 | A * | 6/1940 | Tipton | 217/8 |
| 2,835,429 | A * | 5/1958 | Pellaton | 229/120.15 |

(Continued)

FOREIGN PATENT DOCUMENTS

| | | |
|---|---|---|
| EP | 0 652 159 | 5/1995 |
| FR | 2 816 918 | 5/2002 |
| GB | 2 285 434 | 7/1995 |
| WO | WO 2008/011147 | 1/2008 |

OTHER PUBLICATIONS

International Search Report of PCT/EP2010/004897, Nov. 29, 2010.

*Primary Examiner* — Andrew Perreault
*Assistant Examiner* — James M Van Buskirk
(74) *Attorney, Agent, or Firm* — Collard & Roe, P.C.

(57) ABSTRACT

The invention relates to a transport container (1) consisting of a bottom part (2) and lateral walls (3, 4) extending perpendicularly therefrom. The transport container has cut-outs (7) provided in the bottom region for receiving with accurate fit the goods to be transported, and also a further support means for the goods above the bottom region. The support means is formed by an intermediate wall (10) that can be positioned vertically and fixed laterally to the corresponding lateral walls (4) and to the bottom part (2).

5 Claims, 4 Drawing Sheets

(56) References Cited

Figure 1:
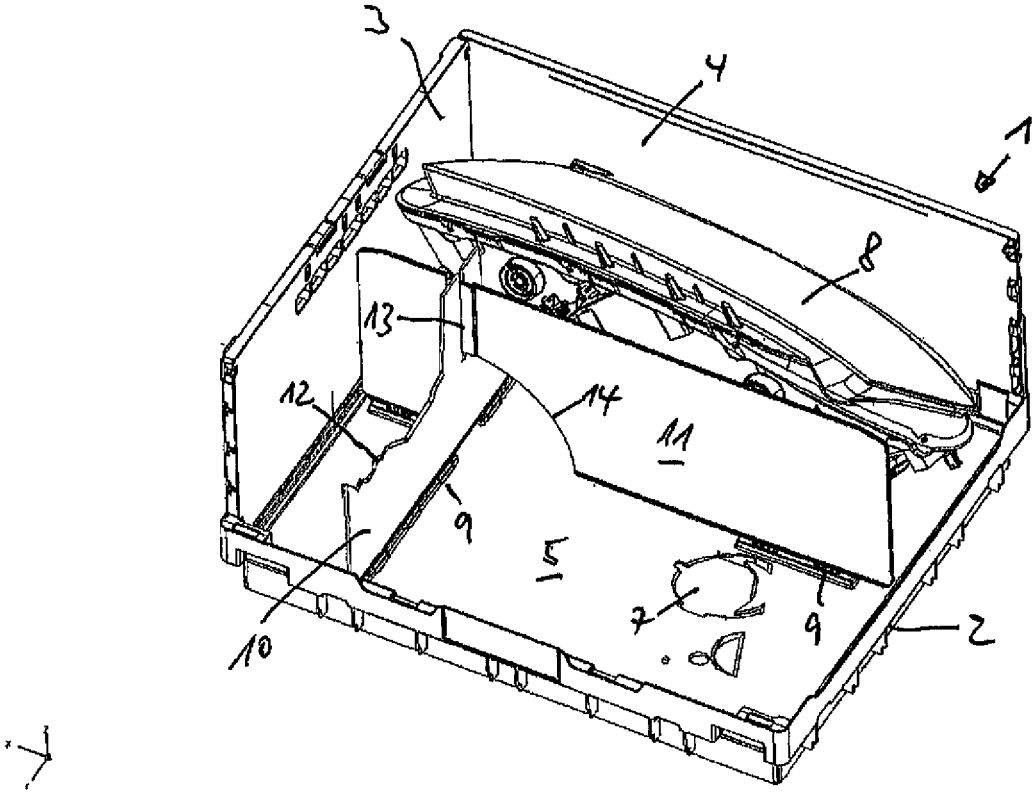

U.S. PATENT DOCUMENTS 3,515,864 A * 6/1970 Levy et al. ..... 362/427
3,516,592 A 6/1970 Friedrich
3,874,546 A * 4/1975 Sanders et al. ..... 220/6
6,056,177 A * 5/2000 Schneider ..... 224/401
6,386,386 B1 * 5/2002 George ..... 220/526
7,740,146 B2 * 6/2010 Cavalcante et al. ..... 220/6

* cited by examiner

TRANSPORT CONTAINER

CROSS REFERENCE TO RELATED APPLICATIONS

This application is the National stage of PCT/EP2010/004897 filed on Aug. 11, 2010, which claims priority under 35 U.S.C. §119 of German Application No. 10 2009 036 993.7 filed Aug. 12, 2009, the disclosure of which is incorporated by reference. The international application under PCT article 21 (2) was not published in English.

The invention relates to a transport container consisting of a bottom part and of side walls that project perpendicular from it, having molded-in parts provided in the bottom region, for accommodating the goods to be transported, with precise fit, and for further support of these goods above the bottom region.

The formed-in parts can be provided in an insert that is laid into the transport container. Or the formed-in parts are an integral component of the bottom itself. The term "bottom part" is selected to distinguish between the actual bottom of the container and the contact surface for the goods to be transported.

As long as the goods to be laid in are configured, in their dimensions, so that their center of gravity projects only insignificantly beyond the insert plane, such a packaging solution offers secure hold for the goods to be packaged, even in the case of rapid movement of the containers during loading and transport.

However, the geometry of goods to be transported, such as motor vehicle headlights, for example, is such that their center of gravity lies so far above the insert plane that despite the molded-in regions in the insert, tilt-free transport of the objects is not always guaranteed. A different, more stable position of the headlights, for example, is not possible for space reasons, because two of the headlights find room in the transport container only by means of their vertical positioning.

The invention is therefore based on the task of configuring a transport container of the type stated initially, in such a manner that the space above the bottom can also be utilized to fix the goods to be transported in place.

The invention accomplishes this task in that the support is formed by means of an intermediate wall that can be set up vertically and can be fixed in place laterally on the corresponding side walls, as well as in the bottom part.

This intermediate wall runs at a right angle to the longitudinal axis of the goods, and has recesses and formed-in parts on its top edge, which are adapted to the shape of the goods to be transported.

The intermediate wall can be pushed into a slit in the bottom part, and laterally into corresponding accommodations in the side walls, for example.

In an advantageous embodiment, however, it is provided that the intermediate wall can be pivoted from a horizontal into a vertical position by means of hinges disposed on the bottom part, and that cam-shaped engagement elements are disposed on the side walls for fixation.

Thus, it is possible, also in this embodiment, to fold the intermediate wall down onto the bottom part after the transport container has been emptied. The advantage as compared with the plug-in variant, however, lies in that the intermediate wall cannot be lost during return transport of the transport container.

Because—as has already been explained above—generally two headlights, for example, are supposed to be accommodated in the transport container, next to one another, it is provided that a partition wall that divides the container into two parts is provided, running at a right angle to the intermediate wall, which partition wall can also be raised up from a horizontal position into the vertical position.

This intermediate wall means further—lateral—support for the goods to be transported, and prevents these goods from bumping against one another during transport.

This partition wall can also be fixed in place in the vertical position, in a slit in the bottom part and corresponding accommodation slits in the side walls, whereby two vertical slits that correspond with one another, in the partition wall and in the intermediate wall, engage into one another.

However, it is advantageously provided that the partition wall can be pivoted into the vertical position by means of hinges disposed on the bottom part, and that cam-shaped engagement elements are disposed on the side walls assigned to the ends of the partition wall, for fixation.

For loading the transport container, first the partition wall is brought into the vertical position, and afterward, the intermediate wall, which is divided in the center according to a first alternative, is raised up into the perpendicular position.

According to an advantageous embodiment, however, a recess in the shape of a quarter circle is provided in the partition wall, the center point of which recess lies in the plane of the bottom, and a slit-shaped guide is provided in the intermediate wall, the bottom-side end of which is guided on the circle circumference, and the pivot axis of the intermediate wall runs through the center point of the quarter circle.

In this way, it is possible to produce the intermediate wall in one piece, so that after the partition wall is raised up, the intermediate wall, provided with the slit-shaped guide in its center, can be folded up on the partition wall.

In another embodiment, it is provided that the transport container is configured so that it can be folded, in other words the side walls can be folded on top of one another with hinges, in the direction of the bottom part, whereby the intermediate wall and/or the partition wall are covered by the side walls in their horizontal position.

In order for the transport container to be suitable also for other purposes of use, it is provided that the intermediate wall and the partition wall are disposed on an insert that can be set onto the bottom of the transport container, in which insert the formed-in parts for accommodating the goods to be transported, with precise fit, are also provided.

If different goods are supposed to be transported, this insert, together with intermediate wall and partition wall, can be removed from the container.

In another embodiment, it is provided that spacers are formed on at the underside of the insert, which spacers stand on the bottom of the transport container. This has the advantage that the goods to be transported can be set into the formed-in parts more deeply.

The cam-shaped engagement elements can consist of a cam part that rises in ramp shape from the side wall plane, which part runs from a maximal height all the way to a stop part, in the direction of the side wall plane.

Since not only the intermediate wall but also the partition wall and the side walls of the transport container generally consist of plastic, the elastic properties of the walls are utilized during the setting-up process, in order to overcome the cam-like elevation and to get into the fixation position on the stop part.

The invention will be shown and explained in greater detail below, using drawings.

Figure 2:
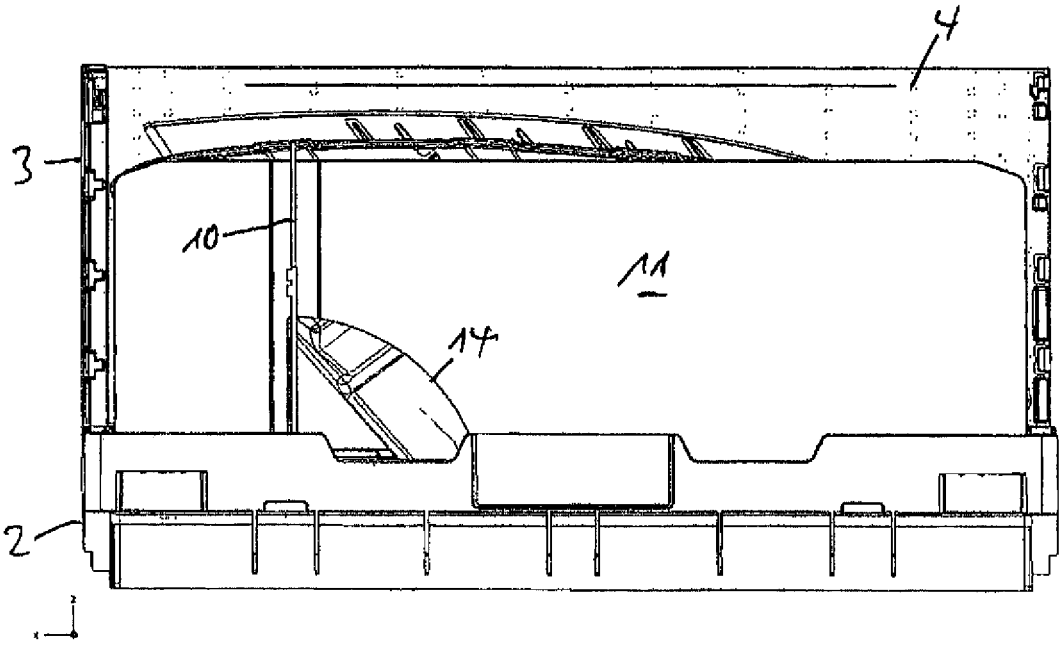
Figure 3:
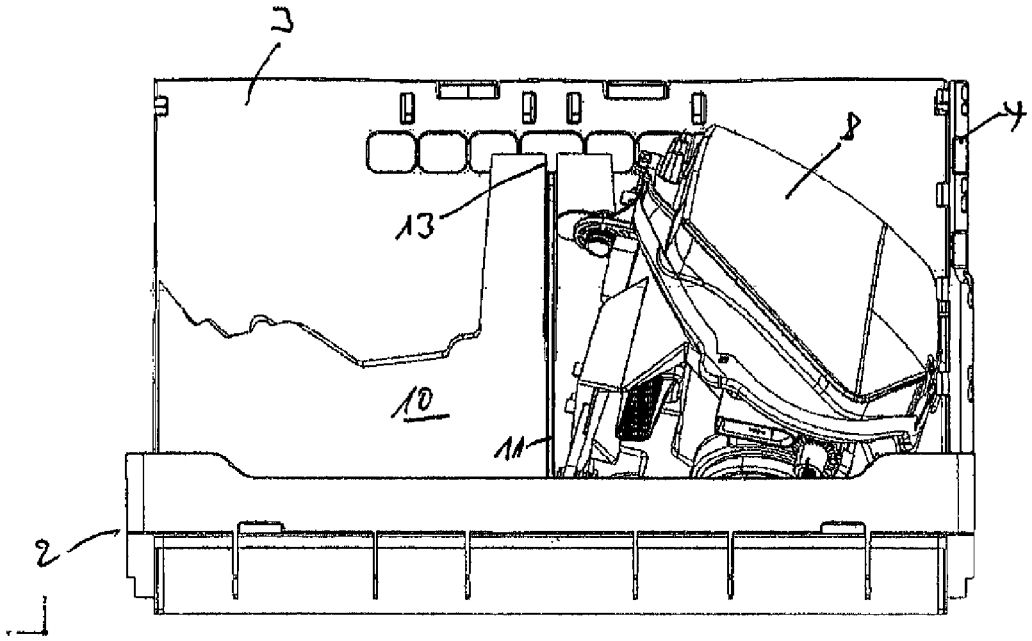
Figure 6:
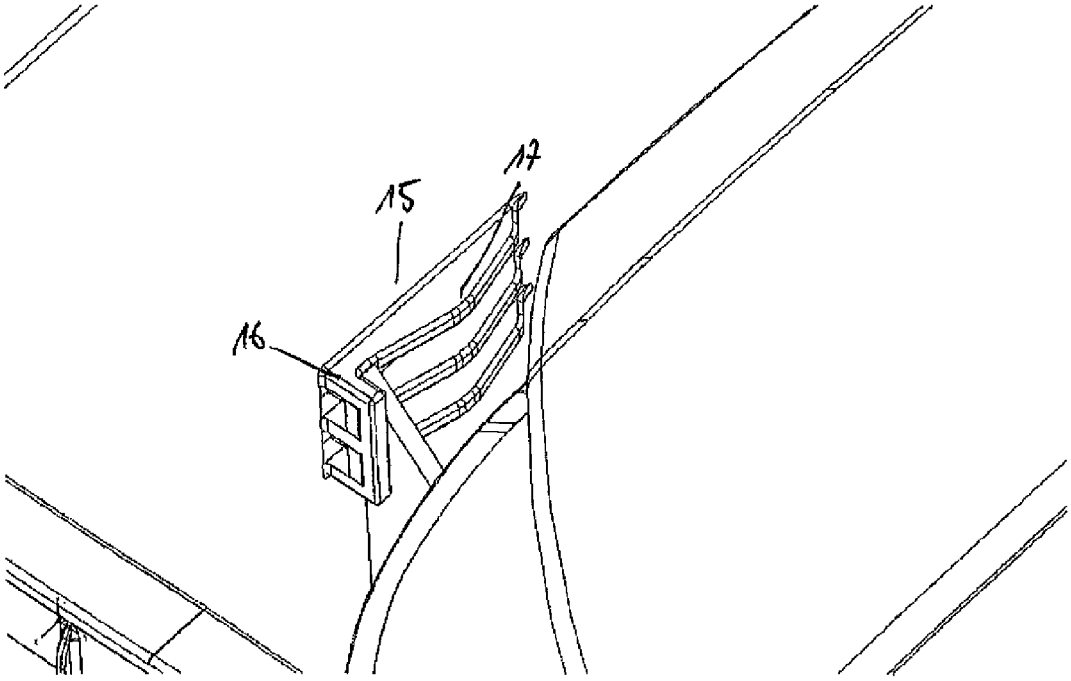
Figure 4:
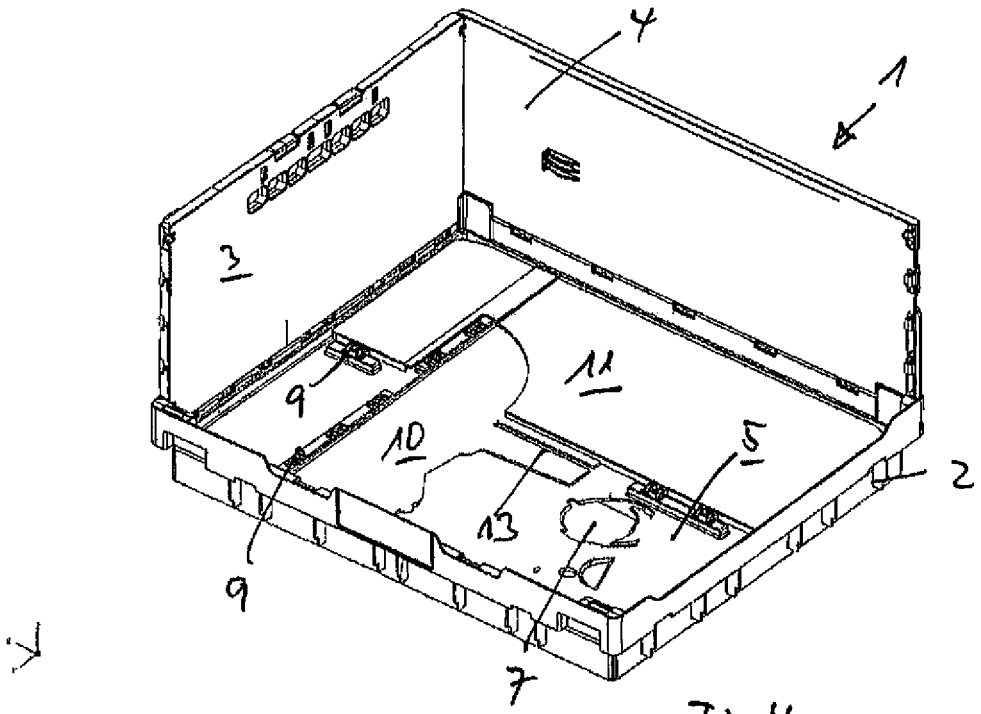
Figure 2:
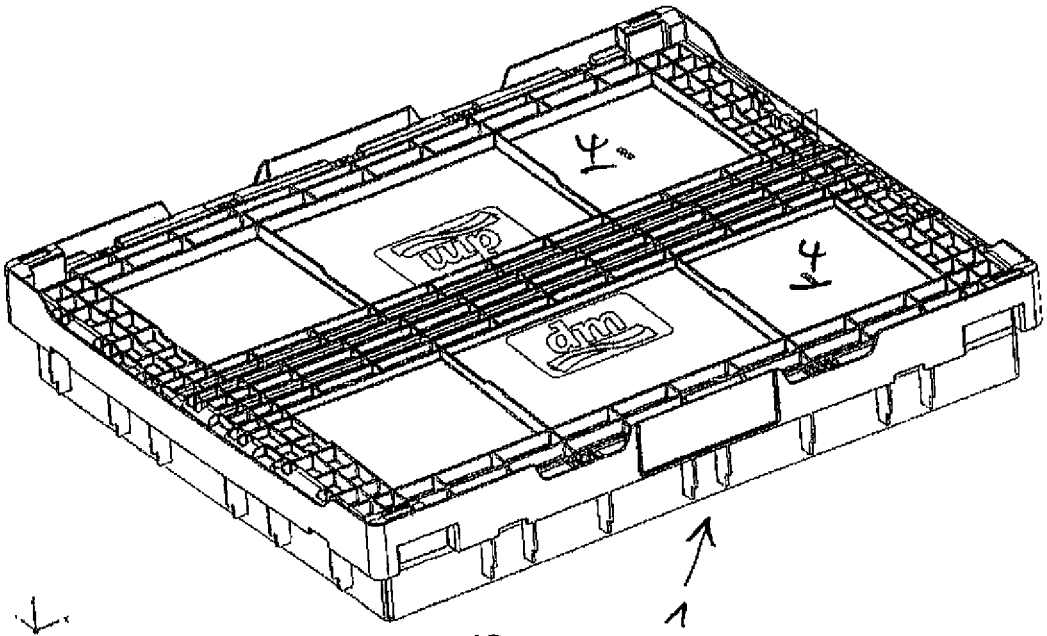

These show:

FIG. 1 in a perspective representation, a transport container in the loading position, FIG. 2 transport container according to FIG. 1 in a longitudinal side view, FIG. 3 transport container according to FIG. 1 in a transverse side view, FIG. 4 insert in a perspective representation, seen from below, FIG. 5 transport container according to claim 1, before the partition wall and intermediate wall are set up, FIG. 6 in a perspective representation, a cam-shaped fixation element, FIG. 7 transport container in the folded-up position.

The figures show a transport container that is provided, in general, with the reference symbol 1.

The transport container consists of a bottom part 2 and of side walls 3 and 4 that rise from this bottom part 2, whereby the side walls 3 are the shorter transverse side walls, and the side walls 4 are the longer longitudinal side walls. In FIG. 1, the front longitudinal side wall and the front transverse side wall are left out, for the sake of clarity of the illustration.

Figure 5:
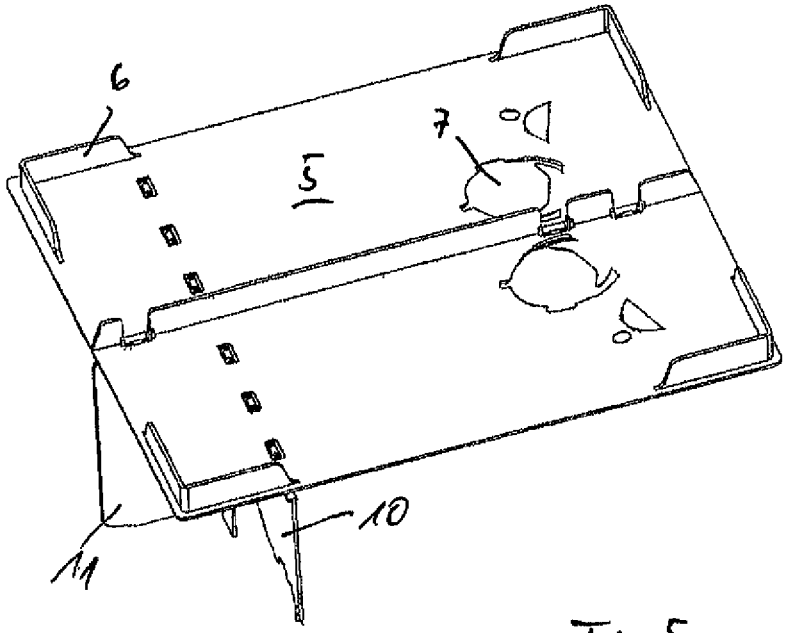

The bottom part 2 consists of an insert 5 that is shown in greater detail in FIG. 5. The bottom part 5 stands on the actual bottom of the transport container 1 with ribs 6 that are configured as spacers.

Recesses 7 are made in the bottom part 5, which serve to accommodate an end part of transport goods, in this case of a motor vehicle headlight 8.

An intermediate wall 10 and a partition wall 11 are disposed in cross shape relative to one another, on the bottom part 5, by means of hinges 9. The intermediate wall is configured in accordance with the contours of the headlight 8 that is to be accommodated in this case, at its upper edge 12.

A slit-shaped guide 13 is disposed in the center, in the intermediate wall, which guide accommodates the partition wall 11. As is more clearly evident from FIG. 2, the partition wall has a recess 14 in the shape of a quarter circle, the center point of which lies in the bottom part plane and through the center point of which the pivot axis of the hinge 9 of the intermediate wall 10 runs.

When the intermediate wall and the partition wall are folded together, the intermediate wall is first folded down along the quarter-circle line. Afterward, the partition wall 11 is folded down onto the intermediate wall.

In this position, the side walls 3 and 4, if they are articulated onto the bottom part with hinges, can then also be folded down onto intermediate and partition walls (see FIG. 7).

To fix the intermediate wall 10 and the partition wall 11 in place, cam-shaped engagement elements 15 are provided on the corresponding side walls 3 or 4. These engagement elements 15 consist of a ramp-like cam 17 that runs from the side wall plane, at a slant, to a maximum, and from here in the direction of the side wall plane, all the way to a stop 16. As a result of the elastic properties of the walls, which are generally made from plastic, the side edges of the intermediate wall 10 and the partition wall 11, respectively, slide over the cams 17 and then engage in front of the stop 16.

The part 8 to be transported is inserted into the recesses 7 in the bottom part 2, on the one hand, and set onto the upper edge 12 of the intermediate wall 10.

The invention claimed is:

1. A transport container comprising: a bottom part; side walls that project perpendicular the bottom part; an intermediate wall configured to be disposed vertically and fixed in place laterally on corresponding ones of the side walls, as well as in the bottom part, wherein the intermediate wall is pilotable from a horizontal into a vertical position by means of hinges disposed on the bottom part, and wherein cam-shaped engagement elements are disposed on the side walls for fixation of the intermediate wall; a partition wall that divides the container into two parts, running at a right angle to the intermediate wall, said partition wall being configured to be raised up from a horizontal position into the vertical position by means of hinges disposed on the bottom part, and wherein cam-shaped engagement elements are disposed on the side walls assigned to ends of the partition wall, for fixation of the partition wall; wherein a recess in the shape of a quarter circle is provided in the partition wall, a center point of the quarter circle recess lies in a plane of the bottom part, and a slit-shaped guide is provided in the intermediate wall, wherein a bottom-side end of the slit-shaped guide is guided on a circumference of the recess, and wherein a pivot axis of the intermediate wall runs through the center point of the quarter circle.

2. The transport container according to claim 1, wherein the side walls are configured to be folded on top of one another with hinges, in a direction of the bottom part, wherein at least one of the intermediate wall and the partition wall are covered by the side walls when the side walls are folded.

3. The transport container according to claim 1, wherein the intermediate wall and the partition wall are disposed on an insert configured to be set onto the bottom of the transport container, in which insert the intermediate wall and partition wall are provided.

4. The transport container according to claim 3, wherein spacers are formed on at underside of the insert, said spacers standing on the bottom of the transport container.

5. The transport container according to claim 1, wherein the cam-shaped engagement elements consist of a cam part that rises in ramp shape from a plane of the side wall, which part runs from a maximal height, dropping to a stop part, in a direction of the wall plane.

* * * * *